US006058633A

United States Patent [19]

Barden

[11] Patent Number: 6,058,633

[45] Date of Patent: May 9, 2000

[54] QUICK COUPLING DEVICE AND METHOD UTILIZING AN OVER-CENTER SPRING

[76] Inventor: William Mark Barden, 4404 Rockwood Dr., Raleigh, N.C. 27612

[21] Appl. No.: 08/955,960

[22] Filed: Oct. 22, 1997

[51] Int. Cl.[7] ..... E02F 3/28; E02F 3/36

[52] U.S. Cl. ..... 37/468; 403/325

[58] Field of Search ..... 37/403, 410, 468; 414/723; 403/31, 320, 321, 322.1, 325

[56] References Cited

U.S. PATENT DOCUMENTS

| | | | |
|---|---|---|---|
| 3,484,124 | 12/1969 | Wille | 403/31 |
| 3,750,227 | 8/1973 | Hayhurst et al. | 403/31 |
| 3,750,311 | 8/1973 | Anderson | 37/188 |
| 4,176,727 | 12/1979 | Perin | 180/53 |
| 4,214,840 | 7/1980 | Beales | 403/31 |
| 4,397,604 | 8/1983 | McCain | 414/723 |
| 4,415,175 | 11/1983 | Kainer | 280/460 |
| 4,417,844 | 11/1983 | De Pingon | 414/723 |
| 4,817,728 | 4/1989 | Scmid et al. | 172/273 |
| 4,944,354 | 7/1990 | Langen et al. | 172/47 |
| 5,050,684 | 9/1991 | Vollmer | 172/272 |
| 5,179,794 | 1/1993 | Ballinger | 37/117.5 |
| 5,324,162 | 6/1994 | Kishi | 414/723 |
| 5,332,353 | 7/1994 | Arnold | 414/723 |
| 5,415,235 | 5/1995 | Gebauer | 172/273 |
| 5,423,625 | 6/1995 | Gebauer et al. | 403/322 |
| 5,441,117 | 8/1995 | Fartmann et al. | 172/272 |
| 5,456,030 | 10/1995 | Barone et al. | 37/468 |
| 5,494,396 | 2/1996 | Geier et al. | 414/723 |
| 5,549,440 | 8/1996 | Cholakon et al. | 414/723 |
| 5,581,917 | 12/1996 | Barden | 37/468 |
| 5,597,283 | 1/1997 | Jones | 414/723 |
| 5,642,785 | 7/1997 | Dam-Rasmussen | 172/272 |
| 5,692,325 | 12/1997 | Kuzutani | 37/468 |
| 5,692,855 | 12/1997 | Burton | 403/325 |

FOREIGN PATENT DOCUMENTS

| | | | |
|---|---|---|---|
| 2177674 | 1/1987 | United Kingdom | E02F 3/96 |
| 2250299 | 7/1998 | United Kingdom | 37/468 |

*Primary Examiner*—Eileen Dunn Lillis
*Assistant Examiner*—Gary S. Hartmann
*Attorney, Agent, or Firm*—Bradford G. Addison

[57] ABSTRACT

A quick coupling device for quickly and easily coupling and decoupling a work implement to and from a stick assembly is disclosed. The quick coupling device includes a hook member defined in the stick assembly. The hook member defines a recess. An implement pin secured to the work implement is positionable within the recess. The quick coupling device further includes an over-center spring which biases or otherwise secures the implement pin within the recess. The quick coupling device yet further includes an actuator which selectively loads the over-center spring so as to secure the implement pin within the recess, or alternatively removes the load from the over-center spring so as to allow the bucket to be decoupled from the stick assembly. In one embodiment the actuator includes a operator controlled fluid cylinder, whereas in another embodiment the actuator includes a lever assembly having a lever with a cam lobe secured thereto.

19 Claims, 5 Drawing Sheets

QUICK COUPLING DEVICE AND METHOD UTILIZING AN OVER-CENTER SPRING

TECHNICAL FIELD OF THE INVENTION

The present invention relates generally to a work machine, and more particularly to a quick coupling device and method which provides quick and easy coupling of a work implement to a work machine.

BACKGROUND OF THE INVENTION

Work machines, such as excavators and backhoes, are generally equipped with a digging and material handling bucket. In particular, the work machine typically includes a stick assembly which has the bucket attached thereto. The bucket is particularly useful for digging or otherwise excavating dirt or other types of material generally present at a work site.

However, during operation of the work machine, it is often desirable to exchange the bucket for a different work implement. In particular, many different types and sizes of buckets are available for attaching to the stick assembly of the work machine in order to facilitate performance of a given work operation. Hence, it may be necessary for a bucket of a first size to be removed from the stick assembly in order to be replaced by a bucket of a second size. In addition to digging buckets, many different types of work implements are also available for use by the work machine. For example, it may be desirable to couple a hydraulic hammer or a grapple to the work machine.

Disconnecting one work implement (e.g. a first digging bucket) and a attaching a different work implement (e.g. a second, larger digging bucket) is often a difficult and time consuming task. In particular, an operator of the work machine must leave the cab of the work machine, disconnect a number of pins, bolts, or other types of fasteners which are provided to mechanically couple the first bucket to the stick assembly. The operator must then mechanically couple the second bucket to the work machine by reconnecting the pins, bolts, and other fasteners associated with the second bucket to the stick assembly. It should be appreciated that during the period of time required to change or swap the buckets, the work machine is idle thereby disadvantageously decreasing the efficiency or productivity of the work machine.

In order to quickly mechanically couple and/or decouple work implements, a number of "quick coupling devices" have heretofore been designed. Such quick coupling devices typically include an apparatus which attempts to quickly and easily mechanically couple and/or decouple the work implement to and/or from the stick assembly. However, many of the quick coupling devices which have heretofore been designed are relatively mechanically complex, and have a relatively large number of components associated therewith thereby disadvantageously increasing costs associated with the work machine.

What is needed therefore is a quick coupling device which overcomes one or more of the aforementioned drawbacks. What is further needed is a quick coupling device which is less mechanically complex relative to quick coupling devices which have heretofore been designed.

SUMMARY OF THE DISCLOSURE

In accordance with a first embodiment of the present invention, there is provided an apparatus for coupling a work implement to a stick assembly. The apparatus includes a hook member defined in the stick assembly. The hook member defines a recess. The apparatus also includes an implement pin secured to the work implement. The implement pin is positionable between (1) a first pin position in which the implement pin is located within the recess, and (2) a second pin position in which the implement pin is spaced apart from the recess. The apparatus further includes an over-center spring which is positionable between (1) a first spring position in which the over-center spring biases the implement pin into the first pin position, and (2) a second spring position in which the over-center spring allows the implement pin to advance between the first pin position and the second pin position. The apparatus yet further includes an actuator which moves the over-center spring between the first spring position and the second spring position.

In accordance with a second embodiment of the present invention, there is provided an apparatus for coupling a work implement to a stick assembly, with the stick assembly having a structural arm and a tilt link. The apparatus includes a first hook member defined in the structural arm. The first hook member defining a first recess. The apparatus further includes a second hook member defined in the tilt link. The second hook member defining a second recess. The apparatus yet further includes a structural implement pin secured to the work implement, the structural pin being positionable between (1) a first structural pin position in which the structural pin is located within the first recess, and (2) a second structural pin position in which the structural pin is spaced apart from the first recess. Moreover, the apparatus includes a tilt implement pin secured to the work implement, the tilt pin being positionable between (1) a first tilt pin position in which the tilt pin is located within the second recess, and (2) a second tilt pin position in which the tilt pin is spaced apart from the second recess. The apparatus also includes a structural over-center spring which is secured to the structural arm, the structural spring being positionable between (1) a first structural spring position in which the structural spring biases the structural pin into the first structural pin position, and (2) a second structural spring position in which the structural spring allows the structural pin to advance between the first structural pin position and the second structural pin position. The apparatus moreover includes a tilt over-center spring which is secured to the tilt link, the tilt spring being positionable between (1) a first tilt spring position in which the tilt spring biases the tilt pin into the first tilt pin position, and (2) a second tilt spring position in which the tilt spring allows the tilt pin to advance between the first tilt pin position and the second tilt pin position. The apparatus further includes a structural actuator which moves the structural spring between the first structural spring position and the second structural spring position. The apparatus moreover includes a tilt actuator which moves the tilt spring between the first tilt spring position and the second tilt spring position.

In accordance with a third embodiment of the present invention, there is provided a method for coupling a work implement to a stick assembly. The method includes the step of positioning an implement pin which is secured to the work implement into a recess of a hook member defined in the stick assembly. The method also includes the step of advancing an actuator from a first actuator position to a second actuator position. The method further includes the step of moving an over-center spring from a unloaded position in which the over-center spring allows the implement pin to advance into the recess of the hook member to a loaded position in which the over-center spring biases the pin into the recess of the hook member, wherein the moving step occurs in response to the advancing step.

BEST MODE FOR CARRYING OUT THE INVENTION

Figure 1:
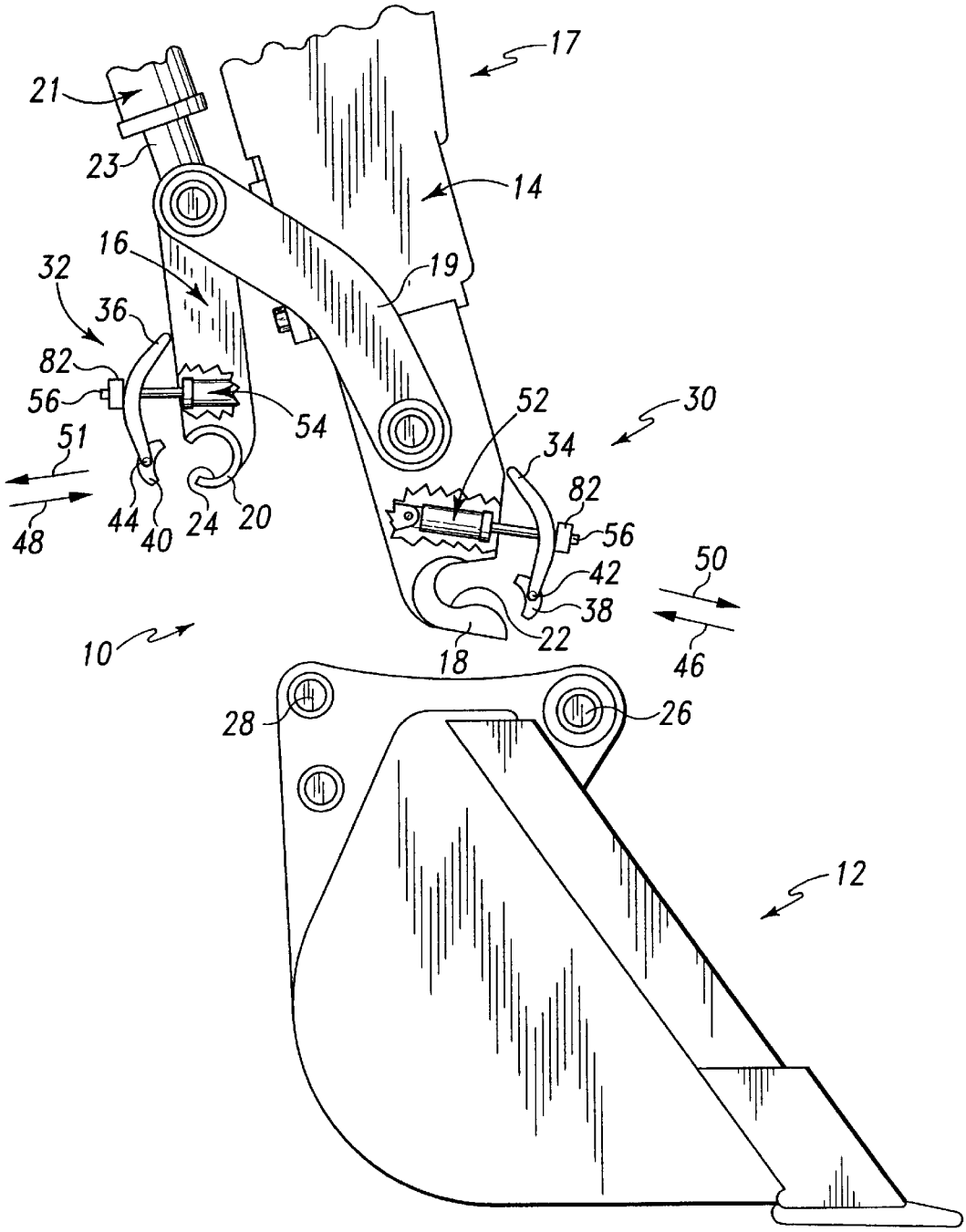
FIG. 1 is a fragmentary side elevational view of the bucket and the stick assembly of a work machine which shows a first embodiment of a quick coupling device which incorporates the features of the present invention therein.

While the invention is susceptible to various modifications and alternative forms, specific embodiments thereof have been shown by way of example in the drawings and will herein be described in detail. It should be understood, however, that there is no intent to limit the invention to the particular forms disclosed, but on the contrary, the intention is to cover all modifications, equivalents, and alternatives falling within the spirit and scope of the invention as defined by the appended claims.

Figure 2:
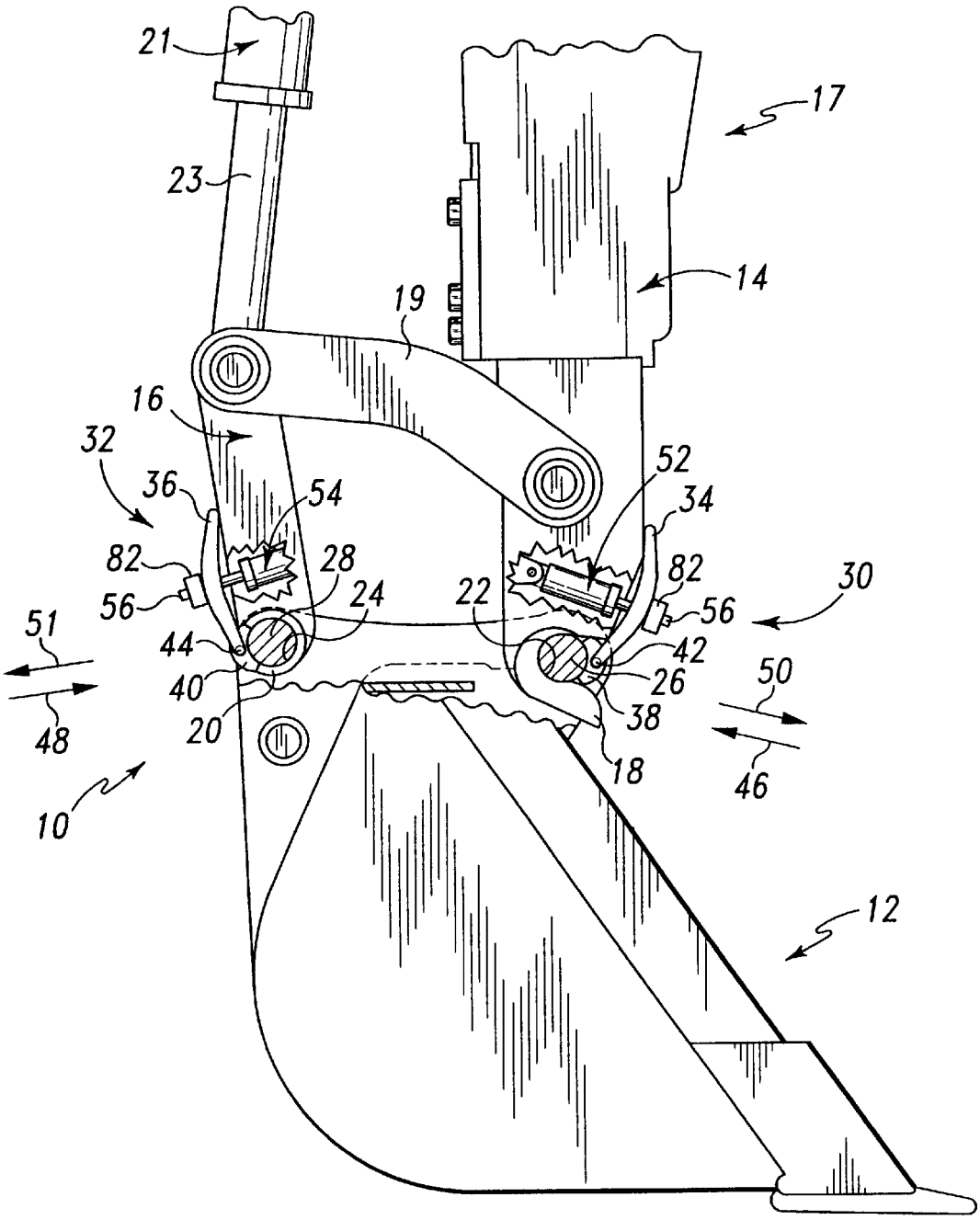
FIG. 2 is a similar to FIG. 1, but showing the bucket coupled to the stick assembly of the work machine, with a portion of the bucket having been cut away for clarity of description.

Referring now to FIGS. 1 and 2, there is shown a quick coupling device 10 for coupling and decoupling a work implement 12, such as a digging bucket, to and from a structural arm 14 and a tilt link 16 of a stick assembly 17 associated with a work machine (not shown) such as an excavator or backhoe. It should be appreciated that when the bucket 12 is secured to the structural arm 14 and the tilt link 16 with the quick coupling device 10, the bucket 12 may be used by the work machine to perform a work operation such as excavating. In particular, the stick assembly 17 further includes a guide link 19 which is pivotally coupled to both the structural arm 14 and the tilt link 16 thereby allowing the tilt link 16 to move relative to the structural arm 14. The motive power for such movement is provided by a tilt cylinder 21 having a rod 23 which may be selectively extended and retracted in order to alter the position of the tilt link 16 thereby facilitating movement of the bucket 12 during a work operation. Moreover, the tilt cylinder 21 may be used to alter the position of the tilt link 16 in order to facilitate coupling and decoupling of the bucket 12 during an implement exchange procedure.

The quick coupling device 10 includes first hook member 18 defined in a first end of the structural arm 14, and a second hook member 20 defined in a first end of the tilt link 16. The first hook member 18 defines an outwardly opening recess 22, whereas the second hook member 20 defines an outwardly opening recess 24. As shown in FIG. 1, the recess 22 opens outwardly in a direction which is substantially opposite to the direction in which the recess 24 opens.

The bucket 12 has a first or structural implement pin 26 and a second or tilt implement pin 28 secured thereto. As shall be discussed below in more detail below, when the first implement pin 26 is secured within the first hook member 18 and the second implement pin 28 is secured within the second hook member 20, the bucket 12 is secured to stick assembly 17 thereby enabling use of the bucket 12 during a work operation such as excavating.

The quick coupling device 10 further includes a pair of clamping assemblies 30, 32. In particular, the clamping assembly 30 is secured to the structural arm 14, whereas the clamping assembly 32 is secured to the tilt link 16. The clamping assembly 30 includes a first or structural over-center load spring 34, whereas the clamping assembly 32 includes a second or tilt over-center load spring 36. The load springs 34, 36 may be any type of bowed, over-center type leaf spring that when compressed beyond a predetermined point exerts a large load in a direction toward the recesses 22, 24, respectively.

A first end of each of the load springs 34, 36 has a load shoe 38, 40, respectively, pivotally secured thereto. In particular, the load shoes 38, 40 are coupled to the load springs 34, 36 via a pair of pin joints 42, 44, respectively. The load shoes 38, 40 are configured so as to be complementary to the shape of the outer surface of the implement pins 26, 28, respectively. Such a configuration enables the load shoes 38, 40 to evenly distribute the load generated by the load springs 34, 36 onto the implement pins 26, 28, respectively, when the implement pins 26, 28 are secured in the recesses 22, 24, respectively.

The load springs 34, 36 are positionable between a loaded position and an unloaded position. In particular, as shown in FIG. 2, once the load spring 34 has been urged or otherwise biased a predetermined distance in the general direction of arrow 46, the load spring 34 snaps into its loaded position in which the load spring 34 exerts a large load on the implement pin 26 through the load shoe 38. Similarly, as shown in FIG. 2, once the load spring 36 has been urged or otherwise biased a predetermined distance in the general direction of arrow 48, the load spring 36 snaps into its loaded position in which the load spring 36 exerts a large load on the implement pin 28 through the load shoe 40.

Conversely, as shown in FIG. 1, if the load spring 34 is urged or otherwise biased a predetermined distance in the general direction of arrow 50, the load spring 34 snaps into its unloaded position thereby removing the large load from the implement pin 26. Similarly, if the load spring 36 is urged or otherwise biased a predetermined distance in the general direction of arrow 51, the load spring 36 snaps into its unloaded position thereby removing the large load from the implement pin 28.

The orientation of the load springs 34, 36 is altered as the load springs 34, 36 are switched between their respective loaded positions and their respective unloaded positions. In particular, when the load springs 34, 36 are positioned in their respective unloaded positions, as shown in FIG. 1, the load springs 34, 36 assume a first bowed orientation, whereas when the load springs 34, 36 are positioned in their respective loaded positions, as shown in FIG. 2, the load springs 34, 36 assume a second bowed orientation. More specifically, as the load springs 34, 36 snap into their respective loaded positions, the load springs 34, 36 flatten out thereby assuming a shape or orientation which is substantially flatter (i.e. less bowed) relative to the shape or orientation of the load springs 34, 36 when positioned in their respective unloaded positions.

Moreover, it should be appreciated that the load springs 34, 36 maintain the same direction of concavity irrespective of whether the load springs 34, 36 are assuming the first bowed orientation (i.e. unloaded) or the second bowed orientation (i.e. loaded). What is meant herein by the phrase "same direction of concavity" is that the concave surface of the load springs 34, 36 face toward the structural arm 14 and the tilt link 16, respectively, irrespective of whether the load springs 34, 36 are positioned in their respective loaded positions or their respective unloaded positions. One type of load spring which is suitable for use as the load springs 34, 36 of the present invention, with minor modification thereof, is the over-center spring of the Universal Strap Clamp which is commercially available from Manhattan Supply Corporation of New York, N.Y. as model number 08104127.

In order to selectively switch the load springs 34, 36 between their respective loaded and unloaded positions, the clamping assemblies 30, 32 each include an actuator or fluid cylinder 52, 54. In particular, a first or structural fluid cylinder 52 is secured to the structural arm 14, whereas a second or tilt fluid cylinder 54 is secured to the tilt link 16.

Figure 5:
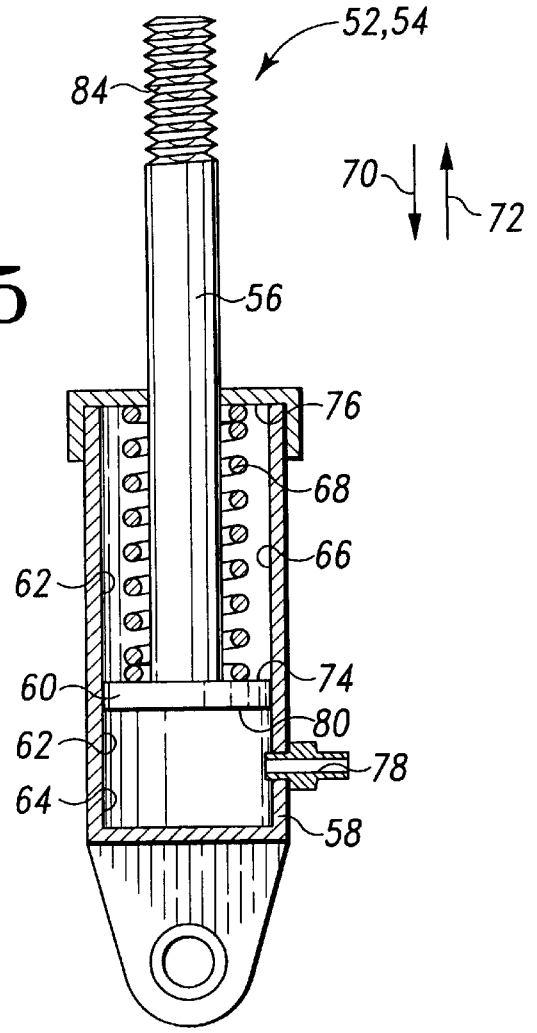
FIG. 5 is a cross-sectional view of the fluid cylinder of the quick coupling device of FIG. 1.

The fluid cylinders 52, 54 are preferably operator controlled fluid cylinders each having a rod 56 extending from a housing 58, as shown in FIG. 5. The rod 56 is coupled at a first end to a piston 60 which translates within a cylinder chamber 62 defined in the housing 58. The piston 60 divides the cylinder chamber 62 thereby defining a fluid chamber 64 and a spring chamber 66. A cylinder spring 68 is disposed in the spring chamber 66 in order to urge or otherwise bias the rod 56 in the general direction of arrow 70 of FIG. 5 thereby placing the fluid cylinders 52, 54 in a respective first or rod retracted position. In particular, the cylinder spring 68 is disposed between an upper surface 74 of the piston 60 and an inner surface 76 of the housing 58 thereby creating a spring bias which urges the piston 60 and hence the rod 56 in the general direction of arrow 70.

Fluid pressure within the fluid chamber 64 selectively urges the rod 56 in the general direction of arrow 72. In particular, a fluid port 78 extends through the housing 58, and is coupled to an operator controlled fluid power circuit (not shown). When operation fluid is advanced under pressure into the fluid chamber 64, fluid pressure acts upon a lower surface 80 of the piston 60 thereby urging the piston 60 and hence the rod 56 in the general direction of arrow 72. It should be appreciated that when fluid pressure within the fluid chamber 64 is greater in magnitude than the magnitude of the spring bias generated by the cylinder spring 68, the piston 60 and hence the rod 56 are moved in the general direction of arrow 72 thereby positioning the fluid cylinders 52, 54 in a respective second or rod extended position.

The fluid cylinders 52, 54 are secured to the load springs 34, 36. In particular, each of the load springs 34, 36 includes a saddle member 82. A threaded portion 84 of the rod 56 is secured to the saddle member 82 thereby coupling the fluid cylinders 52, 54 to the load springs 34, 36, respectively. Hence, the fluid cylinders 52, 54 may be used to selectively position the load springs 34, 36 in either their respective loaded positions or their respective unloaded positions. In particular, the magnitude of the spring bias generated by the cylinder springs 68 of the fluid cylinders 52, 56 is large enough that it causes the rods 56 to urge the load springs 34, 36 beyond a predetermined distance thereby causing the load springs 34, 36 to snap into their respective loaded positions.

Conversely, when high fluid pressure is present in the fluid chambers 64 of the fluid cylinders 52, 54 the rods 56 urge the load springs 34, 36 beyond a predetermined distance thereby causing the load springs to snap back into their respective unloaded positions. Hence, from the above discussion, it should be appreciated that the fluid cylinders 52, 54 may be used to position the load springs 34, 36 in their respective unloaded positions during an implement change procedure, as shown in FIG. 1. Thereafter, the fluid cylinders 52, 54 may be used to position the load springs 34, 36 in their respective loaded positions so as to secure the implement pins 26, 28 within the hook members 18, 20, respectively, once the implement pins 26, 28 have been received into the recesses 22, 24, as shown in FIG. 2.

Figure 3:
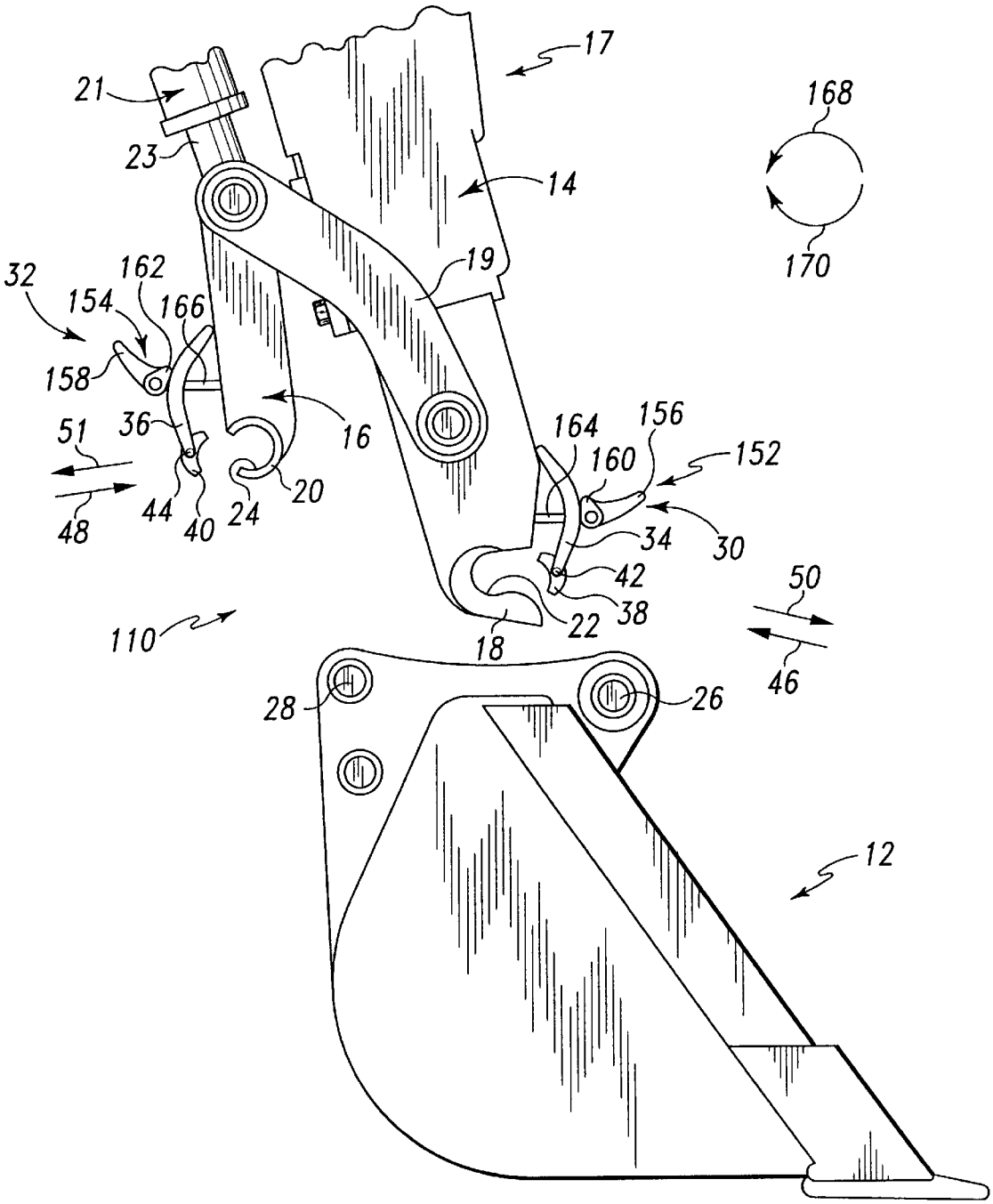
FIG. 3 is a fragmentary side elevational view of the bucket and the stick assembly of a work machine which shows a second embodiment of a quick coupling device which incorporates the features of the present invention therein.
Figure 4:
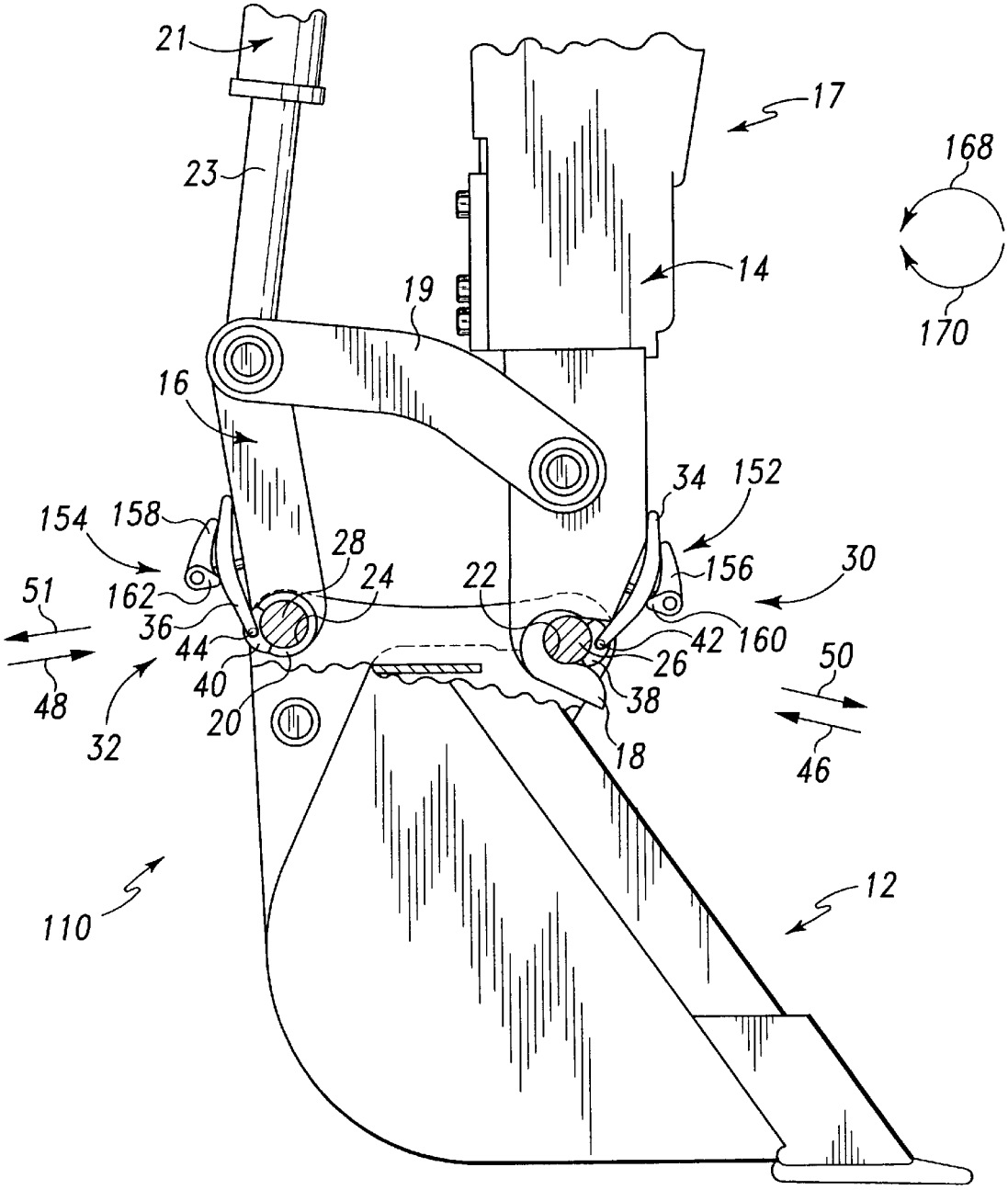
FIG. 4 is a view similar to FIG. 3, but showing the bucket coupled to the stick assembly of the work machine, with a portion of the bucket having been cut away for clarity of description.

Referring now to FIGS. 3–4, there is shown a quick coupling device 110 which is a second embodiment of the present invention. The quick coupling device 110 is somewhat similar to quick coupling device 10. Thus, the same reference numerals are used in FIGS. 3–4 to designate common components which were previously discussed in regard to FIGS. 1–2.

In lieu of the fluid cylinders 52, 54, the clamping assemblies 30, 32 of the quick coupling device 110 includes a pair of actuators or lever assemblies 152, 154. Each of the lever assemblies 152, 154 includes a lever 156, 158 having a cam lobe 160, 162, respectively, secured thereto. The levers 156, 158 rotate about a pair of pivot shafts such as bolts 164, 166, respectively, which are secured to the structural arm 14 and the tilt link 16, respectively.

The lever assemblies 152, 154 may be used to selectively position the load springs 34, 36 in either their respective loaded positions or their respective unloaded positions. In particular, rotation of the levers 156, 158 causes rotation of the cam lobes 160, 162, respectively, thereby exerting a bias or load on the load springs 34, 36, respectively. In particular, as the cam lobe 160 is rotated in the general direction of arrow 168, the load spring 34 is urged in the general direction of arrow 46. Rotation of the cam lobe 160 beyond the maximum height thereof causes the lever assembly 152 to assume a locked position thereby causing the load spring 34 to be urged beyond a predetermined distance which causes the load spring 34 to snap into its loaded position, as shown in FIG. 4. Similarly, as the cam lobe 162 is rotated in the general direction of arrow 170, the load spring 36 is urged in the general direction of arrow 48. Rotation of the cam lobe 162 beyond the maximum height thereof causes the lever assembly 154 to assume a locked position thereby causing the load spring 36 to be urged beyond a predetermined distance which causes the load spring 36 to snap into its loaded position, as shown in FIG. 4.

Conversely, rotation of the levers 156, 158 in the opposite direction causes the bias or load exerted on the load springs 34, 36, respectively, by the cam lobes 160, 162, respectively, to be removed therefrom. In particular, rotation of the cam lobe 160 in the general direction of arrow 170 beyond the maximum height thereof, positions the lever assembly 152 in an unlocked position thereby removing the load generated by the cam lobe 160 from the load spring 34 which allows the load spring 34 to snap back into its unloaded position, as shown in FIG. 3. Similarly, rotation of the cam lobe 162 in the general direction of arrow 168 beyond the maximum height thereof, positions the lever assembly 154 in an unlocked position thereby removing the load generated by the cam lobe 162 from the load spring 36 which allows the load spring 36 to snap back into its unloaded position, as shown in FIG. 3

Figure 6:
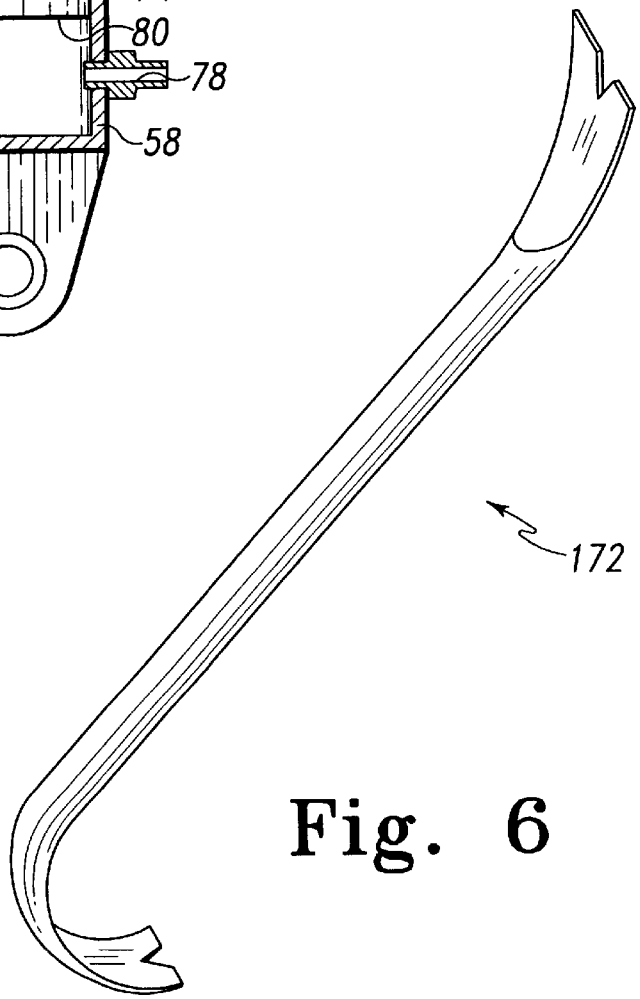
FIG. 6 is a perspective view of a tool bar which is used to lock and unlock the quick coupling device of FIG. 3.

It should be appreciated that the cam lobes 160, 162 generate a relatively high load (e.g. 2000 pounds) on the load springs 34, 36 in order to get the load springs 34, 36 to snap into their respective loaded positions or their respective unloaded positions. Hence, it may be necessary for the operator of the work machine to utilize a tool 172 (see FIG. 6), such as a pole or crow bar, to gain the mechanical advantage necessary to rotate the levers 156, 158.

Industrial Applicability

In operation, the quick coupling devices 10, 110 may be used to quickly and easily couple the stick assembly 17 to the bucket 12. In particular to operation of the quick coupling device 10, the stick assembly 17 is first lowered in a direction toward the bucket 12, as shown in FIG. 1, with the fluid cylinders 52, 54 positioned in their respective rod extended positions so as to position the load springs 34, 36 in their respective unloaded positions. The stick assembly 17 is then advanced such that the implement pins 26, 28 are received into the recesses 22, 24 of the hook members 18, 20, respectively. It should be appreciated that during such advancement, the tilt cylinder 21 may be used to alter the position of the tilt link 16 relative the structural arm 14 in order to facilitate alignment of the implement pins 26, 28 relative to the recesses 22, 24, respectively. Once the implement pins 26, 28 are positioned within the recesses 22, 24, respectively, the fluid cylinders 52, 54 are operated such that the fluid cylinders 52, 54 assume their respective rod retracted positions thereby causing the load springs 34, 36 to snap into their respective loaded positions as shown in FIG. 2. It should be appreciated that when the implement pins 26, 28 are positioned in the recesses 22, 24, respectively, and the load springs 34, 36 are positioned in their respective loaded positions, the bucket 12 is secured to the stick assembly 17 and may thereafter be used to perform a work operation such as excavating.

In order to decouple the bucket 12 from the stick assembly 17, high fluid pressure is generated in the fluid chamber 64 of the fluid cylinders 52, 54 (see FIG. 5) thereby causing the fluid cylinders 52, 54 to assume the rod extended position. As discussed above, when the fluid cylinders 52, 54 are positioned in their respective rod extended positions, the load springs 34, 36 are snapped into their respective unloaded positions. Once the load springs 34, 36 are positioned in their respective unloaded positions, the stick assembly 17 may be moved such that the hook members 18, 20 are spaced apart from the implement pins 26, 28 thereby allowing the stick assembly 17 to be lifted away from the bucket 12.

In particular to operation of the quick coupling device 110, the stick assembly 17 is first lowered in a direction toward the bucket 12, as shown in FIG. 3, with the lever assemblies 152, 154 positioned in their respective unlocked positions so as to position the load springs 34, 36 in their respective unloaded positions. The stick assembly 17 is then advanced such that the implement pins 26, 28 are received into the recesses 22, 24 of the hook members 18, 20, respectively. It should be appreciated that during such advancement, the tilt cylinder 21 may be used to alter the position of the tilt link 16 relative the structural arm 14 in order to facilitate alignment of the implement pins 26, 28 relative to the recesses 22, 24, respectively. Once the implement pins 26, 28 are positioned within the recesses 22, 24, respectively, the operator of the work machine may rotate the lever assemblies 152, 154 such that the lever assemblies 152, 154 are positioned in their respective locked positions thereby causing the load springs 34, 36 to snap into their respective loaded positions, as shown in FIG. 4. It should be appreciated that when the implement pins 26, 28 are positioned in the recesses 22, 24, respectively, and the load springs 34, 36 are positioned in their respective loaded positions, the bucket 12 is secured to the stick assembly 17 and may thereafter be used to perform a work operation such as excavating.

In order to decouple the bucket 12 from the stick assembly 17, the lever assemblies 152, 154 are rotated in an opposite direction thereby causing the lever assemblies 152, 154 to assume their respective unlocked positions. As discussed above, when the lever assemblies 152, 154 are positioned in their respective unlocked positions, the load springs 34, 36 are snapped into their respective unloaded positions. Once the load springs 34, 36 are positioned in their respective unloaded positions, the stick assembly 17 may be moved such that the hook members 18, 20 are spaced apart from the implement pins 26, 28 thereby allowing the stick assembly 17 to be lifted away from the bucket 12.

While the invention has been illustrated and described in detail in the drawings and foregoing description, such illustration and description is to be considered as exemplary and not restrictive in character, it being understood that only the preferred embodiments have been shown and described and that all changes and modifications that come within the spirit of the invention are desired to be protected.

Further, it should be appreciated that although the work implement 12 is herein described as a digging bucket, the quick coupling devices 10, 110 may be used to couple and/or decouple the stick assembly 17 to and from other types of work implements. For example, the quick coupling devices 10, 110 may be used to couple and/or decouple a grapple or a hydraulic hammer to the stick assembly 17.

What is claimed is:

1. An apparatus for coupling a work implement to a stick assembly, comprising:

a hook member defined in said stick assembly, said hook member defining a recess;

an implement pin secured to said work implement, said implement pin being positionable between (1) a first pin position in which said implement pin is located within said recess, and (2) a second pin position in which said implement pin is spaced apart from said recess;

an over-center spring which is positionable between (1) a first spring position in which said over-center spring biases said implement pin into said first pin position, and (2) a second spring position in which said over-center spring allows said implement pin to advance between said first pin position and said second pin position; and an actuator which moves said over-center spring between said first spring position and said second spring position.

2. The apparatus of claim 1, further comprising a load shoe pivotally coupled to said over-center spring, wherein:

said load shoe contacts said implement pin when said over-center spring is positioned in said first spring position, and said load shoe is spaced apart from said implement pin when said over-center spring is positioned in said second spring position.

3. The apparatus of claim 2, wherein said load shoe possesses a concave surface which is complementary to an outer surface of said implement pin.

4. The apparatus of claim 1, wherein:

said over-center spring has a first bowed orientation and a second bowed orientation, said over-center spring assumes said first bowed orientation when said over-center spring is positioned in said first spring position, said over-center spring assumes said second bowed orientation when said over-center spring is positioned in said second spring position, and said first bowed orientation and said second bowed orientation each have the same direction of concavity.

5. The apparatus of claim 1, wherein:

said actuator includes a fluid cylinder, said fluid cylinder is positionable between a first cylinder position and a second cylinder position, said fluid cylinder positions said over-center spring in said first spring position when said fluid cylinder is positioned in said first cylinder position, and said fluid cylinder positions said over-center spring in said second spring position when said fluid cylinder is positioned in said second cylinder position.

6. The apparatus of claim 5, wherein:

said fluid cylinder includes a rod and a housing, said rod is advanced so as to be retracted into said housing when said fluid cylinder is moved from said second cylinder position to said first cylinder position, and said rod is advanced so as to be extended out of said housing when said fluid cylinder is moved from said first cylinder position to said second cylinder position.

7. The apparatus of claim 6, wherein:

said fluid cylinder further includes a cylinder spring and a fluid chamber, said cylinder spring urges said rod into said housing so as to position said fluid cylinder in said first cylinder position, and fluid pressure within said fluid chamber urges said rod out of said housing so as to position said fluid cylinder in said second cylinder position.

8. The apparatus of claim 1, wherein:

said actuator includes a lever positionable between a first lever position and a second lever position, said lever positions said over-center spring in said first spring position when said lever is positioned in said first lever position, and said lever positions said over-center spring in said second spring position when said lever is positioned in said second lever position.

9. The apparatus of claim 8, wherein:

said lever has a cam lobe secured thereto, and rotation of said lever causes said cam lobe to move said over-center spring between said first spring position and said second spring position.

10. An apparatus for coupling a work implement to a stick assembly, with said stick assembly having a structural arm and a tilt link, comprising:

a first hook member defined in said structural arm, said first hook member defining a first recess;

a second hook member defined in said tilt link, said second hook member defining a second recess;

a structural implement pin secured to said work implement, said structural pin being positionable between (1) a first structural pin position in which said structural pin is located within said first recess, and (2) a second structural pin position in which said structural pin is spaced apart from said first recess;

a tilt implement pin secured to said work implement, said tilt pin being positionable between (1) a first tilt pin position in which said tilt pin is located within said second recess, and (2) a second tilt pin position in which said tilt pin is spaced apart from said second recess;

a structural over-center spring which is secured to said structural arm, said structural spring being positionable between (1) a first structural spring position in which said structural spring biases said structural pin into said first structural pin position, and (2) a second structural spring position in which said structural spring allows said structural pin to advance between said first structural pin position and said second structural pin position;

a tilt over-center spring which is secured to said tilt link, said tilt spring being positionable between (1) a first tilt spring position in which said tilt spring biases said tilt pin into said first tilt pin position, and (2) a second tilt spring position in which said tilt spring allows said tilt pin to advance between said first tilt pin position and said second tilt pin position;

a structural actuator which moves said structural spring between said first structural spring position and said second structural spring position; and a tilt actuator which moves said tilt spring between said first tilt spring position and said second tilt spring position.

11. The apparatus of claim 10, further comprising:

a structural load shoe pivotally coupled to said structural spring, a tilt load shoe pivotally coupled to said tilt spring, wherein (1) said structural load shoe contacts said structural pin when said structural spring is positioned in said first structural spring position, (2) said structural load shoe is spaced apart from said structural pin when said structural spring is positioned in said second structural spring position, (3) said tilt load shoe contacts said tilt pin when said tilt spring is positioned in said first tilt spring position, and (4) said tilt load shoe is spaced apart from said tilt pin when said tilt spring is positioned in said second tilt spring position.

12. The apparatus of claim 10, wherein:

said structural actuator includes a first fluid cylinder, said first fluid cylinder is positionable between a first rod retracted position and a first rod extended position, said first fluid cylinder positions said structural spring in said first structural spring position when said first fluid cylinder is positioned in said first rod retracted position, said first fluid cylinder positions said structural spring in said second structural spring position when said first fluid cylinder is positioned in said first rod extended position, said tilt actuator includes a second fluid cylinder, said second fluid cylinder is positionable between a second rod retracted position and a second rod extended position, said second fluid cylinder positions said tilt spring in said first tilt spring position when said second fluid cylinder is positioned in said second rod retracted position, and said second fluid cylinder positions said tilt spring in said second tilt spring position when said second fluid cylinder is positioned in said second rod extended position.

13. The apparatus of claim 12, wherein:

said first fluid cylinder includes (1) a first rod, (2) a first housing, (3) a first cylinder spring, and (4) a first fluid chamber, said first cylinder spring urges said first rod into said first housing so as to position said first fluid cylinder in said first rod retracted position, and fluid pressure within said first fluid chamber urges said first rod out of said first housing so as to position said first fluid cylinder in said first rod extended position, said second fluid cylinder includes (1) a second rod, (2) a second housing, (3) a second cylinder spring, and (4) a second fluid chamber, said second cylinder spring urges said second rod into said second housing so as to position said second fluid cylinder in said second rod retracted position, and fluid pressure within said second fluid chamber urges said second rod out of said second housing so as to position said second fluid cylinder in said second rod extended position.

14. The apparatus of claim 10, wherein:

said structural actuator includes a structural lever positionable between a first structural lever position and a second structural lever position, said structural lever positions said structural spring in said first structural spring position when said structural lever is positioned in said first structural lever position, said structural lever positions said structural spring in said second structural spring position when said structural lever is positioned in said second structural lever position, said tilt actuator includes a tilt lever positionable between a first tilt lever position and a second tilt lever position, said tilt lever positions said tilt spring in said first tilt spring position when said tilt lever is positioned in said first tilt lever position, and said tilt lever positions said tilt spring in said second tilt spring position when said tilt lever is positioned in said second tilt lever position.

15. The apparatus of claim 14, wherein:

said structural lever has a first cam lobe secured thereto, rotation of said structural lever causes said first cam lobe to move said structural spring between said first structural spring position and said second structural spring position, said tilt lever has a second cam lobe secured thereto, and rotation of said tilt lever causes said second cam lobe to move said tilt spring between said first tilt spring position and said second tilt spring position.

16. A method for coupling a work implement to a stick assembly, comprising the steps of:

positioning an implement pin which is secured to the work implement into a recess of a hook member defined in the stick assembly;

advancing an actuator from a first actuator position to a second actuator position; and moving an over-center spring from a unloaded position in which the over-center spring allows the implement pin to advance into the recess of the hook member to a loaded position in which the over-center spring biases the pin into the recess of the hook member, wherein the moving step occurs in response to the advancing step.

17. The method of claim 16, wherein:

the actuator includes a fluid cylinder having a housing and a rod, the actuator advancing step includes the step of retracting the rod into the housing so as to position the over-center spring in the loaded position.

18. The method of claim 17, wherein:

the fluid cylinder further includes a cylinder spring, and the rod retracting step includes the step of urging the rod into the housing with the cylinder spring.

19. The apparatus of claim 16, wherein:

the actuator includes a lever having a cam lobe secured thereto, and the actuator advancing step includes the step of rotating the lever so as to cause the cam lobe to move the over-center spring into the loaded position.

* * * * *